US011621524B2

(12) United States Patent
Frasch

(10) Patent No.: US 11,621,524 B2
(45) Date of Patent: Apr. 4, 2023

(54) ELECTRICAL CONNECTING DEVICE HAVING A MAIN BODY AND A DISPLACEMENT BODY

(71) Applicant: Afag Holding AG, Hergiswil (CH)

(72) Inventor: Tobias Frasch, Villingen-Schwenningen (DE)

(73) Assignee: AFAG HOLDINGAG, Hergiswil (CH)

( * ) Notice: Subject to any disclaimer, the term of this patent is extended or adjusted under 35 U.S.C. 154(b) by 11 days.

(21) Appl. No.: 17/340,956

(22) Filed: Jun. 7, 2021

(65) Prior Publication Data

US 2021/0384674 A1 Dec. 9, 2021

(30) Foreign Application Priority Data

Jun. 9, 2020 (EP) ..... 20179079

(51) Int. Cl.
*H01R 13/631* (2006.01)
*H01R 13/24* (2006.01)
*H01R 13/52* (2006.01)

(52) U.S. Cl.
CPC ..... *H01R 13/6315* (2013.01); *H01R 13/2407* (2013.01); *H01R 13/5219* (2013.01)

(58) Field of Classification Search
CPC ..... H01R 13/6315; H01R 13/2407; H01R 13/5219; H01R 13/26; H01R 13/5202; H01R 13/052

(Continued)

(56) References Cited

U.S. PATENT DOCUMENTS 4,770,644 A 9/1988 Feder
6,783,380 B1 * 8/2004 Kamath ..... H01R 13/62905 439/247

(Continued)

FOREIGN PATENT DOCUMENTS

CN 108496281 A * 9/2018 ..... H01R 13/052
CN 109428209 B 5/2020

(Continued)

OTHER PUBLICATIONS

European Search Report dated Nov. 17, 2020, EP Application 20 17 9079, 2 Pages.

(Continued)

*Primary Examiner* — Marcus E Harcum
(74) *Attorney, Agent, or Firm* — Lucas & Mercanti, LLP; Klaus P. Stoffel

(57) ABSTRACT

An electrical connecting device having a main body and a displacement body mounted in a linearly movable manner relative to one another in a longitudinal direction. The main body has a cavity that accommodates a longitudinal section of the displacement body or vice versa. The length of the longitudinal section accommodated in the cavity is variable by a relative longitudinal movement of the main body and the displacement body. The main body has conductor tracks extending in the longitudinal direction and insulated from one another. The displacement body has sliding elements insulated from one another and resting on and electrically contacting a contact surface of a respective one of the conductor tracks. The conductor tracks are arranged on a main body surface of the main body. The main body surface is round in a cross-sectional plane perpendicular to the longitudinal direction or is formed by a plurality of surface sections angled in relation to one another. The sliding elements project from a displacement body surface of the displacement body. The displacement body surface is round (Continued)

in the cross-sectional plane or is formed by a plurality of surface sections angled in relation to one another. The contact surfaces of at least two of the conductor tracks are angled in relation to one another.

11 Claims, 2 Drawing Sheets

(58) Field of Classification Search
USPC ..... 439/252, 174, 700, 32, 9, 112, 116, 332, 439/337, 843
See application file for complete search history.

(56) References Cited

U.S. PATENT DOCUMENTS

| | | | | |
|---|---|---|---|---|
| 7,114,955 | B2 | 10/2006 | Poth | |
| 7,789,690 | B1 * | 9/2010 | Rhein | H01R 13/707 439/352 |
| 8,007,284 | B2 * | 8/2011 | Smith | H02G 3/0666 439/32 |
| 9,966,713 | B1 * | 5/2018 | Shaeffer | H01R 24/86 |
| 10,128,594 | B2 * | 11/2018 | Govari | A61B 18/1492 |
| 10,224,659 | B2 * | 3/2019 | Pemwieser | H01R 4/48 |
| 10,431,944 | B1 | 10/2019 | Su | |
| 10,644,450 | B2 * | 5/2020 | Su | H01R 4/489 |
| 2001/0012703 | A1 * | 8/2001 | Wurm | E21B 3/02 439/32 |
| 2004/0180563 | A1 * | 9/2004 | Coughlan | H01R 13/53 439/181 |
| 2010/0048037 | A1 * | 2/2010 | Wormsbecher | H05K 7/1492 439/32 |
| 2010/0130046 | A1 | 5/2010 | Carle | |
| 2010/0191299 | A1 * | 7/2010 | Ayzenberg | H01R 13/187 439/682 |
| 2010/0210151 | A1 * | 8/2010 | Niles | H01R 13/111 439/851 |
| 2010/0240228 | A1 * | 9/2010 | Lenhert | H01R 13/187 439/32 |
| 2013/0244467 | A1 * | 9/2013 | Tran | H01R 13/635 439/337 |
| 2015/0295329 | A1 * | 10/2015 | Oguro | G03B 17/14 439/676 |
| 2018/0013222 | A1 * | 1/2018 | Kuroda | H01R 13/2428 |
| 2018/0325579 | A1 | 11/2018 | Haughton | |
| 2019/0058285 | A1 | 2/2019 | Yao | |
| 2020/0136314 | A1 * | 4/2020 | Kim | H01R 13/6315 |
| 2021/0005995 | A1 * | 1/2021 | Mangstl | H01R 13/193 |
| 2021/0005998 | A1 * | 1/2021 | Mayville | H01R 13/052 |
| 2021/0313746 | A1 * | 10/2021 | Kato | H04N 5/2251 |

FOREIGN PATENT DOCUMENTS

| | | | | |
|---|---|---|---|---|
| DE | 10208704 | A1 | 9/2003 | |
| EP | 2321880 | B1 * | 5/2015 | H01R 12/724 |
| EP | 3185371 | A1 | 6/2017 | |

OTHER PUBLICATIONS

Canadian Intellectual Property Office issued an Examiner's Report dated Oct. 6, 2022 regarding parallel Canadian Patent Application No. 3,121,760, 8 pages.

* cited by examiner

ELECTRICAL CONNECTING DEVICE HAVING A MAIN BODY AND A DISPLACEMENT BODY

CROSS-REFERENCE TO RELATED APPLICATIONS

The present application claims priority of EP 20 17 9079.7, filed Jun. 9, 2020, the priority of this application is hereby claimed, and this application is incorporated herein by reference.

BACKGROUND OF THE INVENTION

The invention relates to an electrical connecting device having a main body and a displacement body which are mounted in a linearly movable manner in relation to one another in a longitudinal direction, wherein the main body has a cavity in which a longitudinal section of the displacement body is accommodated or vice versa, wherein the length of the longitudinal section accommodated in the cavity is variable by a relative movement of the main body and the displacement body in the longitudinal direction.

In a large number of machines, various components are routed linearly in relation to one another. In this case, signals or current are often intended to be conducted to a moving component. For example, it is possible for signals or current to be intended to be conducted to a moving carriage or to a telescopically extending component. Fields of application for such current or signal conductance can be found, for example, in handling technology, automation technology, assembly technology, linear technology and in the field of manipulators and portals. In principle, flexible cables could be used for connecting components that move linearly in relation to one another. In order to ensure that the minimum permissible bending radius of the cables is not undershot, said cables are typically routed by a cable drag chain here. However, this can lead to additional use of installation space and limit achievable cycle times.

Another approach for contacting components that move linearly in relation to one another is known from document DE 102 08 704 A1. Said document proposes routing a contact pin telescopically within a conductive tube, wherein conductive rollers are arranged on the contact pin and are pressed against the inner surface of the conductive tube by compression springs in order to electrically contact said conductive tube. The described arrangement is advantageous since, owing to the arrangement of the contact area in a cavity, said contact area is protected against contaminants and electric shock protection can be implemented in a simple manner. In addition, the described contacting exhibits a low level of wear. However, one disadvantage is that, when contacting a large number of signal lines or current supply lines, a relatively high level of expenditure and a relatively large installation space requirement result.

SUMMARY OF THE INVENTION

Therefore, the invention is based on the object of providing a connection for a plurality of signal or power lines with a low level of technical expenditure and use of installation space.

According to the invention, the object is achieved by an electrical connecting device of the kind mentioned at the outset, wherein the main body has a plurality of conductor tracks extending in the longitudinal direction and insulated from one another and the displacement body has a plurality of sliding elements insulated from one another and resting on a contact surface of a respective one of the conductor tracks for electrically contacting the conductor tracks, wherein the conductor tracks are arranged on a main body surface of the main body, which main body surface is round in a cross-sectional plane perpendicular to the longitudinal direction or is formed by a plurality of surface sections angled in relation to one another, and/or wherein the sliding elements project from a displacement body surface of the displacement body, which displacement body surface is round in the cross-sectional plane or is formed by a plurality of surface sections angled in relation to one another, and/or wherein the contact surfaces of at least two of the conductor tracks are angled in relation to one another.

It has been found within the scope of the invention that electrical contacting can be implemented in a particularly compact manner when the respective contact elements, that is to say the sliding elements or conductor tracks, are not arranged next to one another in one plane, but rather when their surfaces are angled in relation to one another or they are arranged in a manner distributed in a circumferential direction perpendicular to the longitudinal direction in a gap between the main body and the displacement body. As a result, even a slight increase in the diameter of the connecting device may be sufficient in order to create space for additional conductor tracks or sliding elements. Therefore, whereas a minimum width of the connection, which is made up of the width of the conductor tracks and the conductor track spacing, results with conventional contacting with conductor tracks running in parallel, this use of installation space is reduced within the scope of the invention by way of this area being folded or rolled up in order to reduce its extent.

The main body preferably has the cavity and the displacement body is partially accommodated in said cavity. The sliding elements can be of relatively short construction in the longitudinal direction, so that the result of this may be that the sliding elements remain within the cavity of the main body in any possible position between the main body and the displacement body. As a result, electric shock protection for all current-conducting components can be achieved with particularly simple means since both the conductor tracks and also the sliding elements always remain within the cavity. For the same reason, such an arrangement can also contribute to preventing soiling of the contact areas. As an alternative, it would also be possible, in principle, for the main body to be accommodated in a cavity of the displacement body.

The relative displacement of the main body and the displacement body can be performed manually or by an actuator system, not associated with the connecting device, for example an actuator system of a machine, which comprises the electrical connecting device. The linear routing of the displacement body with respect to the main body can be implemented by the electrical connecting device itself. Particularly advantageous embodiments of such bearing will be explained in more detail below. However, it would also be possible, in principle, to achieve the linear routing of the two components with respect to one another using external components. The electrical connecting device can serve, in particular, to electrically contact components that move linearly in relation to one another in a machine.

The displacement body can be, in particular freely, displaced between two extreme positions with respect to the main body, wherein the electrical connecting device can have, in particular, stops or the like in order to limit a displacement path. A respective sliding element and a respective conductor track preferably remain in contact over the entire displacement path between the extreme positions. In other words, the slide is routed along the conductor track during the displacement of the displacement body with respect to the main body. The described electrical connecting device is suitable for transmitting high currents and also for providing signal lines or the like with small current flows. Here, all pairs comprising conductor tracks and sliding elements can conduct similar currents. However, it is also possible for some of the pairs to serve for conducting high currents, while other pairs form, for example, digital signal lines.

The main body surface or the displacement body surface has the described shape in particular within each cross-sectional plane within a section in the longitudinal direction of the electrical connecting device, in which section the conductor tracks extend or in which section the sliding elements are fitted. A round shape is understood to mean, in particular, a circular shape, but also an elliptical shape or the like. In particular, at least three conductor tracks and at least three sliding elements can be distributed along the respective surface in the circumferential direction. In particular, even numbers of conductor tracks or sliding elements which are situated opposite one another can be used.

When forming the main or displacement body surface by a plurality of surface sections angled in relation to one another, the respective surface may be, in particular, polygonal. However, it is also possible for the flat sections to be connected by rounded corners or the like. The surface sections angled in relation to one another can each have at least one conductor track or at least one sliding element. Here, in particular, even numbers of conductor tracks or sliding elements can be used, wherein in each case two of the conductor tracks are arranged on opposite sides of the main body surface and, in particular, parallel to one another. However, it may also be advantageous when some of the surface sections angled in relation to one another do not have a conductor track or a sliding element. This can serve, for example, to form projections between grooves in which the conductor tracks are arranged. As a result, firstly robust insulation of the conductor tracks in relation to one another can be realized. Secondly, corresponding grooves can serve to route the sliding elements and therefore to block a relative rotation of the main body and the displacement body in relation to one another if this is not achieved by other means in any case.

The sliding elements can be, in particular, elastically prestressed, so that routing and centering of the displacement body or of the main body within the cavity are performed at the same time by the contact of the sliding elements with the respective conductor track. The sliding elements can project from the displacement body surface in directions angled in relation to one another.

The main body and/or the displacement body can be designed as a rod-like hollow body or a rod-like solid body. A main or displacement body designed as a rod-like hollow body can also be called a tubular main or displacement body. In particular, the body forming the cavity, that is to say preferably the main body, is a hollow body or is tubular and at least partially incorporates the other body, that is to say preferably the displacement body, which may be a solid or a hollow body. A tubular shape of a displacement body accommodated in the cavity may be advantageous, for example, in order to route connection lines for the sliding elements in the interior of the displacement body to said displacement body. In general, the main body and the displacement body can be inserted, in particular, telescopically one into the other.

The main body can have, for at least one of the conductor tracks, an associated further conductor track, wherein the respective conductor track and the respective associated further conductor track are arranged opposite one another on the main body in the or a cross-sectional plane perpendicular to the longitudinal direction and are conductively connected to one another. In addition or as an alternative, the displacement body can have, for at least one of the sliding elements, an associated further sliding element, wherein the respective sliding element and the respective associated further sliding element are arranged opposite one another on the displacement body in the cross-sectional plane and are conductively connected to one another. This can serve, in particular, to provide a redundant contact pair by a respective pair of a conductor track and a further conductor track or a sliding element and a further sliding element, which redundant contact pair conducts the same signal or carries out common current conductance.

Although a movement of the displacement body with respect to the main body perpendicularly to the longitudinal direction in this case leads, under certain circumstances, to poorer contact between the conductor track and the sliding element, the further conductor track and the further sliding element are moved more strongly one onto the other, as a result of which the poorer contact between the conductor track and the sliding element can be at least largely compensated for. This applies conversely for the opposite movement direction. Therefore, since fluctuations in the contact quality are largely compensated for by a movement of the main body and the displacement body perpendicularly to the longitudinal direction, relatively weak clamping forces can be used for contacting the sliding element and the conductor track or the further sliding element and the further conductor track, as a result of which a low level of wear also results for the corresponding contacts.

When the longitudinal section of the displacement body is accommodated in the cavity of the main body, the sliding elements can preferably be conductively connected to connection lines. The connection lines can be routed at least in sections through an inner cavity of the displacement body. As explained above, the displacement body can be, in particular, tubular here and the connection lines can be routed through the interior of the tube. In particular, the connection lines can be routed in the interior of the cavity as far as an open end of the displacement body, in order to there encircle the end side of the displacement body and to contact the sliding elements, in particular arranged close to the end side. As an alternative, it would also be possible, for example, for the wall of the sliding element to have apertures through which the connection lines are routed in order to contact the sliding elements or through which the sliding elements are routed in order to contact the connection lines.

As an alternative, the connection lines can be routed outside the cavity. As an alternative, the displacement body may be a solid body, that is to say in particular not have a cavity.

The main body can comprise a sheet-like line carrier that can be bent in a flexible manner at least in sections, supports the conductor tracks and is held in a bent position by way of being inserted in bent form into a tube of the main body and/or by way of two edges of the line carrier being fastened to one another. For example, the contact means carrier used may be a so-called rigid flex printed circuit board which comprises rigid and flexible sections which, in particular in the finished electrical connecting device, alternate in the circumferential direction of the main body. The rigid sections can have, for example, conductor tracks or else projections arranged between them. By way of using flexible sections, the rigid sections can be moved into a position at an angle in relation to one another. By way of connecting the edges of the line carrier, an inherently stable main body can be formed in this case, so that an outer tube is not absolutely necessary for stabilization purposes. However, an outer tube may nevertheless be used in order to further increase the robustness of the electrical connecting device. As an alternative, the conductor tracks could be fitted, for example, on a film or foil, e.g. a semiflex printed circuit board film or foil, as a result of which an inherently stable main body typically does not result solely by bending the film or foil. Therefore, the bent film or foil can be inserted into a tube in order to retain the shape once it has been prespecified.

The line carrier can be a printed circuit board or film or foil on which the conductor tracks are directly applied. Here, the conductor tracks can be, for example, printed on or produced by etching. As an alternative, the line carrier can also support separately produced conductor tracks, for example thin metal sheets, which can be, for example, adhesively bonded or held in a positive or non-positive manner.

The line carrier can have an electromagnetic radiation-shielding sheathing, which is formed in particular by the tube, and/or an electromagnetic radiation-shielding coating. The sheathing or coating can be, in particular, conductive. The sheathing or coating can preferably be conductively connected to a reference potential during operation of the connecting device. Owing to the sheathing or coating, the electromagnetic compatibility (EMC) of the connecting device can be improved or signals routed by this connecting device can be shielded against interference. This function can be fulfilled, e.g., by the tube, in particular when it is formed from conductive material. However, e.g., a copper coating, a sheathing by ferrite foil or the like can also be used.

In general, the line carrier and/or the conductor tracks can each be flexible, semiflexible or rigid.

The conductor track and/or the line carrier can be clamped by an elastically deformed tolerance compensation element at least on one side in the longitudinal direction. For example, a seal or another elastically deformable element can to be clamped between a screw screwed into the tube at the end side and the conductor tracks or the line carrier. On the other side in the longitudinal direction, the conductor tracks or the line carrier can be clamped, for example, by a bearing for longitudinal routing, a sealing ring or another elastically deformed tolerance compensation element. Clamping by at least one tolerance compensation element can compensate for slight differences in length of the individual conductor tracks or tolerances in the production of the line carrier with a low level of expenditure, in particular when, as explained above, used in conjunction with a screw.

A sealing means, in particular a sealing ring, can be arranged between the main body and the displacement body. This sealing means can serve firstly to protect the cavity, and therefore the region in which the electrical contacts are situated, against foreign bodies, dust, splashes etc. Sealing measures of varying complexity can be taken here depending on the class of protection desired. Since the body that forms the cavity, that is to say in particular the main body, can be sealed off in a leaktight manner without problems on all sides apart from the side on which the displacement body or the main body projects beyond the cavity, even relatively simple sealing off, for example using a sealing ring, may be sufficient in order to achieve a desired class of protection. A seal, in particular a sealing ring, can serve as a linear guide at the same time, so that, for example, the routing of the displacement body with respect to the main body can already be realized jointly by such sealing at one end of the body that forms the cavity, that is to say in particular of the main body, and the support of the displacement body on the main body by the sliding elements.

The respective sliding element can be a bending spring, in particular a leaf spring. In particular, a pre-bent bending spring, which bears against the conductor track by way of a spring bow, can be used. As a result, a lower degree of wear of the conductor track can be achieved than in the case of the end of the spring resting on it. One end of the bending spring can be fastened to the displacement body and the other end can be pressed onto the surface of the displacement body or routed in a recess of the displacement body by the tension of the bending spring between the main body and the displacement body. Therefore, in particular, one of the ends of the bending spring can be displaceable in the longitudinal direction with respect to the displacement body when the force exerted by the main body onto the bending spring varies. The sliding element or, in particular, the bending spring can be fastened to the displacement body by adhesive bonding, soldering, welding, latching or the like.

The sliding element or a contact section or contact point of the respective sliding element by way of which the respective contact element contacts the respective conductor track can be matched in terms of its mechanical and/or electrical properties to the specific application of the connecting device. For example, different current intensities and/or frequencies can be transmitted for different connecting devices or an expected frequency, a typical length and/or a typical speed of the displacement of the displacement body with respect to the main body can vary. Accordingly, e.g., the size and/or the shape of a contact area between the sliding element and the conductor track, a spring hardness of a sliding element designed as a spring, a surface material etc. can be varied in order to adjust to a specified application.

The main body can form, for at least one pair of adjacent conductor tracks, a projection which extends between the conductor tracks in the longitudinal direction. As a result, robust insulation of the conductor tracks or the sliding elements in relation to one another can be realized. At the same time, corresponding projections can serve to route the sliding elements, so that, in particular, rotation of the displacement body in relation to the main body about an axis running in the longitudinal direction can be blocked by the interaction of the projections and the sliding elements.

In each case at least one ground conductor track can be arranged in the circumferential direction between at least one of the conductor tracks and a respective further one of the conductor tracks and extends parallel to the respective conductor track in the longitudinal direction of the main body. The ground conductor track or the ground conductor tracks can be connected to a defined reference potential, e.g. to the ground potential, during operation of the connecting device. In other words, an apparatus comprising the connecting device can be designed in such a way that the reference potential is applied to the at least one ground conductor track during operation of the apparatus.

On account of a ground conductor track being routed on one side or preferably on both sides of at least one of the conductor tracks, a pseudo coaxial line is produced, in the case of which interfering influences act substantially equally on a signal line, that is to say the conductor track, and a ground connection, that is to say the ground conductor track. This reduces an influence of such interfering influences, without symmetrical signal conductance being required.

Conductor tracks and ground conductor tracks can be arranged e.g. alternately in the circumferential direction of the main body. The ground conductor tracks do not necessarily have to be contacted by the displacement body. The ground conductor tracks can be short-circuited with respect to one another within the connecting device or by means of an apparatus comprising said connecting device since said ground conductor tracks are intended to be connected to a common reference potential.

The main body can comprise a respective termination resistor for at least one of the conductor tracks and/or the displacement body can comprise a respective termination resistor for at least one of the sliding elements. The respective termination resistor can couple the respective conductor track or the respective sliding element in the region of a respective free end to a reference potential, e.g. a ground potential. The free end can be considered to be that section which, starting from a main body-side or displacement body-side connection of the connecting device for contacting an external device, is situated on the other side of the contact point between the sliding element and the conductor track. If an alternating voltage signal is applied to the conductor track or the sliding element, said alternating voltage signal is conducted by the respective conductor track or the respective sliding element beyond the contact point in the direction of the respective free end and reflected there. This reflection can be at least largely suppressed by using a suitable termination resistor. The use of termination resistors at free ends of signal lines is known in principle from the prior art and therefore does not need to be explained in detail. The termination resistor can be a non-reactive resistor or else a complex resistor which is formed for example by an LC element.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
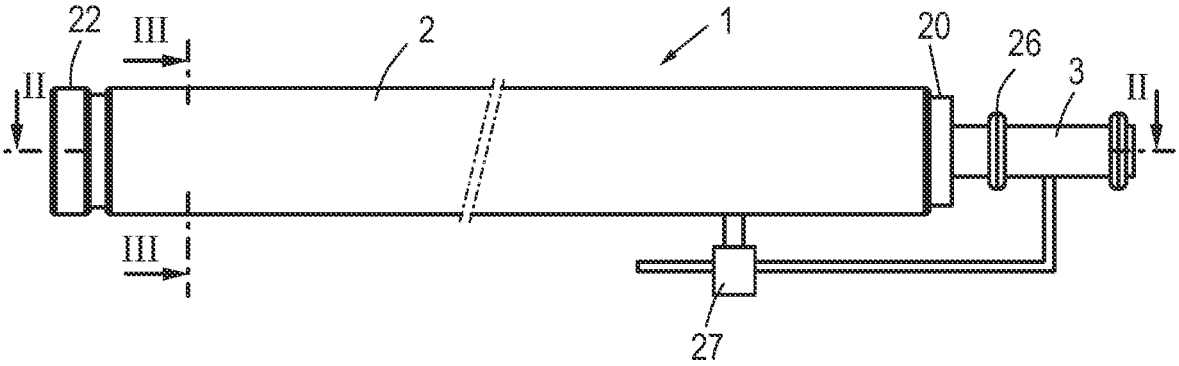
FIG. 1 schematically shows an exemplary embodiment of an electrical connecting device according to the invention, FIG. 2 schematically shows a sectioned view of the connecting device shown in FIG. 1 along line II-II, FIG. 3 schematically shows a sectioned view of the connecting device shown in FIG. 1 along line III-III, and FIG. 4 schematically shows a line carrier used in the connecting device according to FIG. 1 before shaping and insertion of said line carrier into a tube for forming the main body.
Figure 2:
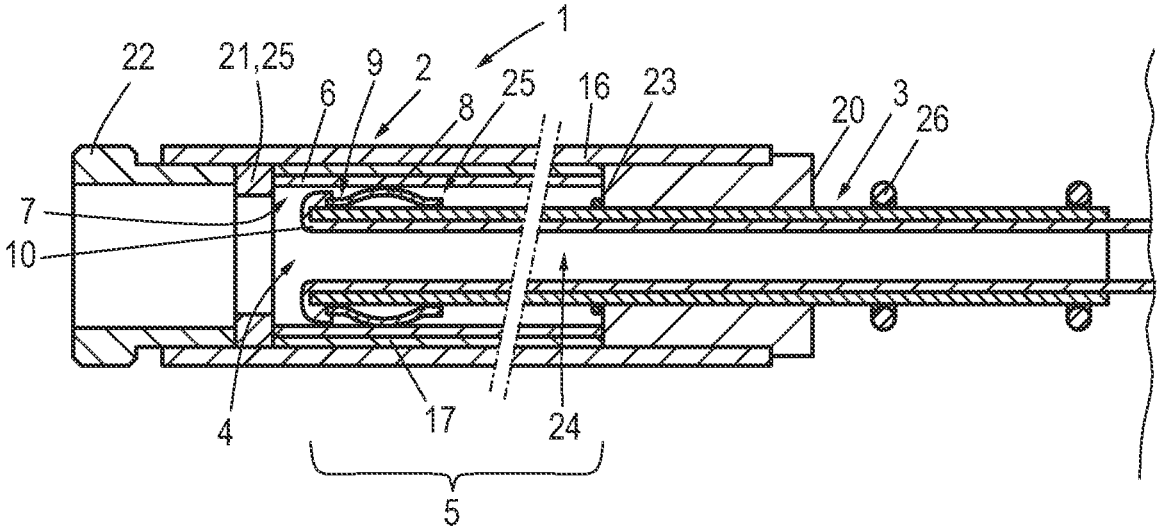
Figure 3:
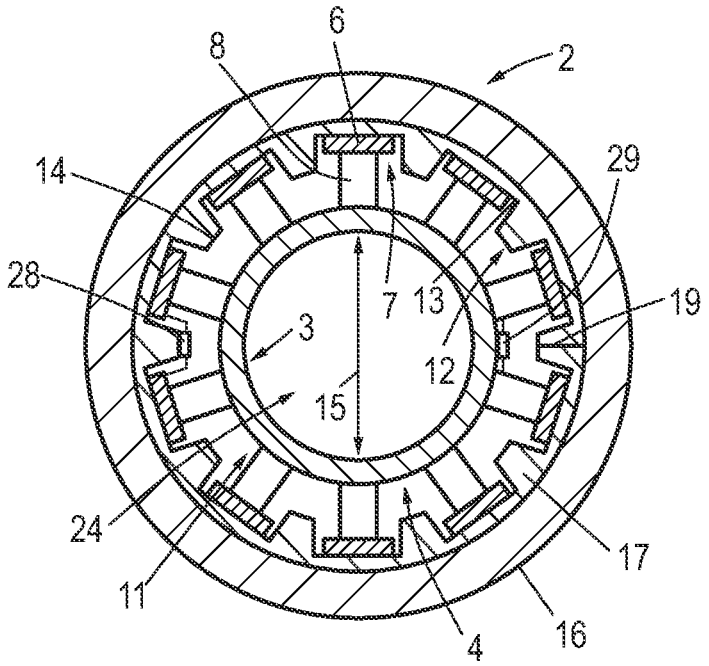

FIG. 1 shows an electrical connecting device 1 having a main body 2 and a displacement body 3 which are mounted such that they can move in a longitudinal direction, specifically transversely in FIG. 1, in relation to one another. The relative displacement of the main body 2 and the displacement body 3 is performed by an actuator system 27 of the machine shown in FIG. 1. FIG. 2 shows a section through the connecting device 1 along line II-II and FIG. 3 shows such a section along line III-III. As shown in FIGS. 2 and 3, the main body 2 has a cavity 4 in which a longitudinal section 5 of the displacement body 3 is accommodated. The length of the longitudinal section 5 and therefore the entire extent of the connecting device in the longitudinal direction is variable by a relative movement of the main body 2 and the displacement body 3.

The main body 2 supports a plurality of, in the example ten, conductor tracks 6 which extend in the longitudinal direction. The contact surface 7 of the respective conductor tracks 6 is contacted by a respective sliding element 8, in the example a leaf spring. As shown in FIG. 2, the leaf spring in the example is fastened at one end 9 to the displacement body 3 and additionally contacts a respective connection line 10 which is routed in an inner cavity 24 of the displacement body 3. The other end 25 of the leaf spring is substantially freely movable in the longitudinal direction in order to compensate for a deformation of the leaf spring due to an exertion of force by the contact surface 7.

On the part of the main body 2, the conductor tracks 6 and, on the part of the displacement body 3, the sliding elements 8 or the connection lines 10 contacting them can be contacted by contact means, not illustrated, of the electrical connecting device 1. As a result, an electrical connection with a variable length for a large number of different signals or power lines can be realized with a low level of technical expenditure.

In order to achieve a compact construction of the electrical connecting device 1 in spite of the relatively large number of separate contacts, conductor tracks 6 are used, the contact areas 7 of which, as clearly shown in particular in FIG. 3, are angled in relation to one another. Accordingly, the sliding elements 8 project from the displacement body surface 11 of the displacement body 3 in different directions.

In the example, the displacement body surface 11 is circular. However, the main body surface 12, which supports the conductor tracks 6, is formed from a large number of surface sections 13 angled in relation to one another. Ten of the surface sections 13 each support one of the conductor tracks 6. The remaining surface sections form projections 14 which firstly serve to ensure robust insulation between the various conductor tracks 6 or sliding elements 8. Secondly, these projections 14 can contribute to blocking a relative rotation of the displacement body 3 and the main body 2 when this is not realized by other means, for example by linear routing of the components coupled by means of the connecting device 1 in a machine, in any case.

In principle, ten separate signals or currents could be transmitted with the refinement of the connecting device 1 illustrated in the example. In an advantageous refinement of the connecting device, the respective opposite conductor tracks 6 or sliding elements 8, as is schematically illustrated by the arrow 15 for such a pair in FIG. 3, are conductively connected to one another. As a result, fluctuating contact qualities in the event of a relative movement of the main body 2 and the displacement body 3 perpendicular to the longitudinal direction can be largely compensated for.

If, for example, the displacement body 3 is moved somewhat upward in FIG. 3, somewhat poorer contact of the bottommost sliding element 8 with the bottommost conductor track 6 results since the sliding element 8 is pressed onto the conductor track 6 with a smaller force. However, at the same time, the topmost one of the sliding elements 8 is more strongly compressed owing to this movement and therefore presses onto the contact surface 7 of the topmost conductor track 6 with a higher contact pressure. Since the topmost conductor track 6 and the bottommost conductor track 6 are situated opposite one another and are conductively connected to one another and the same applies to the corresponding sliding elements 8, the potential impairment of one of the contacts is therefore at least largely compensated for by an improvement in the other of the contacts. On account of the relatively large number of conductor tracks 6 and sliding elements 8 used, five independent signals or currents can nevertheless still be transmitted.

The main body comprises a termination resistor 28 for a conductor track 6. Additionally, the displacement body 3 comprises a termination resistor 29 for a sliding element 8. It would also be possible to only use a termination resistor 28, 29 in the main body 2 or the displacement body 3 or to use multiple respective termination resistors 28, 29 in the main body 2 and/or in the displacement body 3.

In addition, on account of the described arrangement of the conductor tracks 6 and sliding elements 8, the respective number can be readily increased, without a considerable increase in installation space being required. For example, sixteen conductor tracks and sliding elements can be used in order to form eight independent signal lines, for example for a Gigabit Ethernet connection. It would also be possible, for example, to use forty or more conductor tracks and sliding elements.

Figure 4:
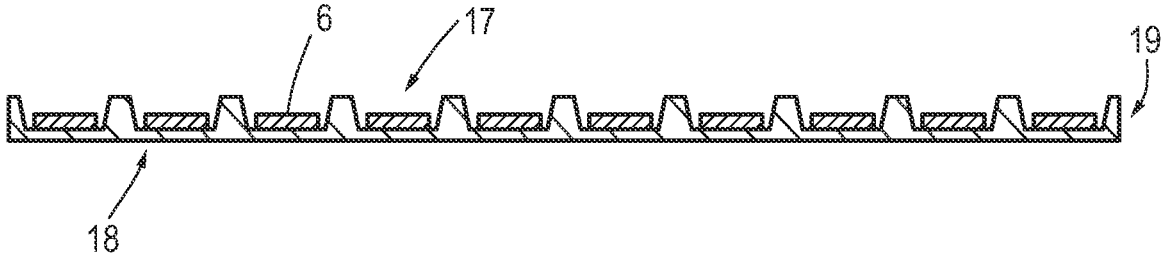

In the example shown, the main body 2 is formed by way of a line carrier 17 that can be bent in a flexible manner at least in sections being inserted into a tube 16. As is illustrated in FIG. 4, the line carrier 17 can initially be produced as a flat line carrier 17. The conductor tracks 6 can be fastened, for example adhesively bonded, to said line carrier as separate components or can be produced, for example, by printed circuit board etching or printing directly onto the line carrier 17. The line carrier 17 can be bent in sections and can be stiff in sections in particular in the transverse direction in FIG. 4. This can be achieved, for example, by way of the line carrier 17 being thinly milled in sections from the rear side 18 in order to achieve a degree of bendability. The line carrier 17 can then be bent, in particular in such a way that its edges 19 touch, and inserted into the tube 16. As a result, the conductor tracks 6 distributed in the circumferential direction can be produced on the inner side of the main body 2 with a low level of technical expenditure.

If the line carrier 17 is sufficiently stiff, the use of the tube 16 can also be dispensed with under certain circumstances, for example when the edges 19 of the line carrier 17 are adhesively bonded to one another or connected in some other way. Secondly, it would also be possible to use, instead of a line carrier 17 that is stiff in sections, an entirely flexible line carrier or a conductive foil which can be adhesively bonded, for example, to the inner side of the tube 16.

In the example, as shown in FIG. 2, the line carrier 17 or the conductor tracks 6 are fixedly clamped in the tube 16 by the sliding bearing 20 and the screw 22. For example, during the production of the connecting device, the sliding bearing 20 can first be inserted, then the line carrier 17 can be inserted into the tube 16 and the tube can then be closed by the screw 22. In order to compensate for length tolerances of the line carrier 17 or of the conductor tracks 6, an elastically deformed tolerance compensation element 21, for example a seal 25, is clamped between the screw 22 and the line carrier 17 in the example.

Owing to the arrangement of the sliding elements 8 and the conductor tracks 6 within the cavity 4, they are largely protected against contaminants. This is the case in particular since the tube 16 is closed off on one side by the screw 22 with the seal 25 arranged thereon, as a result of which a high degree of sealing is typically achieved on this side in any case. On the opposite side, the use of the sliding bearing 20 already leads to sealing off from relatively large particles and extensive sealing off from dust.

If stronger sealing is desired, an additional sealing means 23 can be applied to the inner and/or outer side of the sliding bearing 20 for example. A further apparatus, for example a linearly moving component, can be coupled to the displacement body by means of the sealing rings 26, illustrated only by way of example, wherein owing to the use of the sealing rings 26 firstly an action of forces that do not act in the longitudinal direction can be damped and secondly the electrical contacting of the further apparatus can be sealed off from environmental influences too.

While specific embodiments of the invention have been shown and described in detail to illustrate the inventive principles, it will be understood that the invention may be embodied otherwise without departing from such principles.

I claim:

1. Electrical connecting device having a main body and a displacement body which are mounted in a linearly movable manner in relation to one another in a longitudinal direction, wherein the main body has a cavity in which a longitudinal section of the displacement body is accommodated or vice versa, wherein the length of the longitudinal section accommodated in the cavity is variable by a relative movement of the main body and the displacement body in the longitudinal direction, characterized in that the main body has a plurality of conductor tracks extending in the longitudinal direction and insulated from one another and the displacement body has a plurality of sliding elements insulated from one another and resting on a contact surface of a respective one of the conductor tracks for electrically contacting the conductor tracks, wherein the conductor tracks are arranged on a main body surface of the main body, which the main body surface is round in a cross-sectional plane perpendicular to the longitudinal direction or is formed by a plurality of surface sections angled in relation to one another, and/or wherein the sliding elements project from a displacement body surface of the displacement body, which the displacement body surface is round in the cross-sectional plane or is formed by a plurality of surface sections angled in relation to one another, and/or wherein the contact surfaces of at least two of the conductor tracks are angled in relation to one another, and/or wherein the contact surfaces of at least two of the conductor tracks are angled in relation to one another, wherein the main body comprises a sheet-like line carrier that can be bent in a flexible manner at least in sections, supports the conductor tracks and is held in a bent position by way of being inserted in bent form into a tube of the main body and/or by way of two edges of the line carrier being fastened to one another.

2. Electrical connecting device according to claim 1, wherein the main body and/or the displacement body are each designed as a rod-like hollow body or a rod-like solid body.

3. Electrical connecting device according to claim 1, wherein the main body has, for at least one of the conductor tracks, an associated further conductor track, wherein the respective conductor track and the respective associated further conductor track are arranged opposite one another on the main body in the or a cross-sectional plane perpendicular to the longitudinal direction and are conductively connected to one another, and/or in that the displacement body has, for at least one of the sliding elements, an associated further sliding element, wherein the respective sliding element and the respective associated further sliding element are arranged opposite one another on the displacement body in the cross-sectional plane and are conductively connected to one another.

4. Electrical connecting device according to claim 1, wherein the longitudinal section of the displacement body is accommodated in the cavity of the main body, characterized in that the sliding elements are conductively connected to connection lines, wherein firstly the connection lines are routed at least in sections through an inner cavity of the displacement body or outside the cavity or wherein secondly the displacement body is a solid body.

5. Electrical connecting device according to claim 1, wherein the line carrier has an electromagnetic radiation-shielding sheathing, which is formed in particular by the tube, and/or an electromagnetic radiation-shielding coating.

6. Electrical connecting device according to claim 1, wherein the conductor tracks and/or the line carrier are/is clamped by an elastically deformed tolerance compensation element at least on one side in the longitudinal direction.

7. Electrical connecting device according to claim 1, wherein a sealing means is arranged between the main body and the displacement body.

8. Electrical connecting device according to claim 1, wherein the respective sliding element is a bending spring, in particular a leaf spring.

9. Electrical connecting device according to claim 1, wherein the main body forms, for at least one pair of adjacent conductor tracks, a projection which extends between the conductor tracks in the longitudinal direction.

10. Electrical connecting device according to claim 1, wherein in each case at least one ground conductor track is arranged in the circumferential direction between at least one of the conductor tracks and a respective further one of the conductor tracks and extends parallel to the respective conductor track in the longitudinal direction of the main body.

11. Electrical connecting device according to claim 1, wherein the main body comprises a respective termination resistor for at least one of the conductor tracks, and/or in that the displacement body comprises a respective termination resistor for at least one of the sliding elements.

* * * * *